United States Patent [19]

Hauser

[11] Patent Number: 4,634,029

[45] Date of Patent: Jan. 6, 1987

[54] EXTERNAL BOTTLE CAP

[75] Inventor: Hugo Hauser, Palo Alto, Calif.

[73] Assignee: Tritec Industries, Inc., Mountain View, Calif.

[21] Appl. No.: 823,992

[22] Filed: Jan. 29, 1986

[51] Int. Cl.[4] ..... B65D 47/06

[52] U.S. Cl. ..... 222/567; 215/272; 215/316; 222/478

[58] Field of Search ..... 222/563, 562, 567, 153, 222/478, 511; 215/272, 316; 285/319, 291

[56] References Cited

U.S. PATENT DOCUMENTS

| | | | |
|---|---|---|---|
| 2,723,773 | 11/1955 | Greene | 215/272 |
| 2,779,517 | 1/1957 | Beall | 222/567 |
| 3,149,762 | 9/1964 | Decker | 222/567 |

*Primary Examiner*—H. Grant Skaggs
*Attorney, Agent, or Firm*—Thomas E. Schatzel

[57] ABSTRACT

A quick release closure for bottles which provides access to fluids contained therein. The closure includes a U-shaped spider portion having two opposed pairs of legs, and a disk-shaped plug portion having two opposed pairs of slots for receiving the legs and for fitting within the spider. Each leg includes an inward facing lip at a distal end for engaging a flange around a bottle neck, and an outward seal face for abutting an O-ring encircling the plug. The legs also include, at a proximal end, an inward facing wedge for engaging the slots of the plug whereby the legs may be urged outward as the plug rides up over the wedge. The plug further includes a ring-shaped cavity for sealingly receiving the mouth of a bottle, and a pair of fluid channels, having internal openings formed within the ring-shaped cavity, and external openings formed between the slots of the plug. The plug and spider portions are biased apart by means of a spring, and the plug is retained within the spider by the lips formed into the lower distal portion of the legs.

6 Claims, 3 Drawing Figures

EXTERNAL BOTTLE CAP

BACKGROUND OF THE INVENTION

1. Field of the Invention

The present invention relates to an improved quick release closure device for bottles or similar containers, and more particularly to a quick release closure device which may securely seal a bottle containing corrosive or toxic liquid, and includes means to withdraw liquids from the sealed container.

2. Description of the Prior Art

In the manufacture of integrated microelectronic components it is imperative to provide carefully controlled processing conditions to maximize the yield of acceptable products. Processing of these microelectronic circuits or semiconductor chips is typically performed in batches of several hundred or more. Accordingly, any processing anomaly or error can render useless a large number of potential products. This is especially true, for example, in photolithograph processes where silicon substrates are chemically etched to form typographical patterns which are essential to the operation of the microelectronic circuits. In conjunction with chemical etches of semiconductor substrates, is well-known to coat certain portions of the silicon substrate with a thin layer of a polymeric liquid known as a photoresist. Upon exposure to preselected radiation, the photoresist rapidly solidifies to form a protective layer on the selectively coated portions of the substrate to protect those portions from chemical attack during subsequent etching. Such coatings of photoresist must be continuous over the area to be protected, otherwise a portion of the coated area will undergo etching and the electronic circuit will probably be rendered useless. The causes of such discontinuities in photoresist coatings have been found to include impurities or particles which are introduced to the process as the photoresist is dispensed from container or reservoir bottles. Accordingly, it is important in the fabrication of microelectronic semiconductor circuits to minimize the opportunity for particulate impurities to enter the photoresist liquid.

In a typical microelectronic fabrication operation, photoresist is dispensed periodically by pumping from relatively small bottles. The practice of using small bottles relates to numerous factors including the expense, toxicity and shelf life of the chemical. Because the individual containers for the photoresist liquid are relatively small, it is necessary to frequently replace the bottles in the dispensing equipment or replenish their contents. Prior art methods of replacment or replenishment have often permitted particles to enter the bottles. For example, it has been found that the photoresist may solidify in the bottles at locations on or near the caps so that when a cap is removed or replaced, some of the solidified material may flake away and fall into the photoresist liquid. Such flakes may not completely dissolve prior to being pumped out of the bottles and may cause imperfections in the photoresist coatings.

Due to the toxicity and corrosiveness of the liquids contained in the bottles or containers, it is important that the containers be sealed tightly to prevent escape of liquid or fumes, yet also provide a fluid channel for access to the liquid therein. Also due to the need for frequent replacement or replenishment operations, it is desirable that a sealing closure be simple and quick to insert onto and remove from the bottle.

SUMMARY OF THE INVENTION

An object of the present invention is to provide an improved device for sealing bottles to minimize the opportunities for particulate matter to enter the liquid within the bottle during replacement or replenishment operations.

It is a further object of the present invention to provide a self-sealing bottle closure means which will securely seal the bottle against toxic and/or corrosive liquid or fumes.

It is a further object of the present invention to provide a self-sealing closure device for bottles which includes means to withdraw liquid from the sealed containers.

It is a further object of the present invention to provide a self-sealing bottle closure means which allows for quick and efficient sealing and unsealing of the bottle.

It is yet another object of the present invention to provide a self-sealing bottle closure device which is easily adaptable to fit virtually any bottle size.

Briefly, a preferred embodiment of the present invention comprises a quick release, sealing container closure including a spider portion and a slidably mating plug portion. The spider portion includes a generally disk-shaped upper portion from which four legs extend perpendicularly downward. The legs are flexibly attached and spaced ninety degrees apart about the periphery of the disk-shaped upper portion, and are capable of bending slightly outward. Each leg has a distal end including an inward facing lip, and an outward facing raised surface defining a seal face. A proximal end of each leg includes an inward facing wedge surface, largest at the top of the leg, which acts in conjunction with the plug to expand the legs outwardly. An inner disk-shaped cavity is provided on the downward facing disk surface of the spider for receiving a spring biasing means. The plug is also generally disk-shaped, slightly larger in diameter than the spider and includes four radial slots, spaced ninety degrees apart about the periphery of the plug for mating with the legs such that the plug may slidably fit within the spider. A lower portion of the plug includes a ring-shaped slot, defining a sealing cavity for sealingly abutting a container mouth. A pair of fluid channels are formed in the plug and include internal orifaces formed within the area bounded by the sealing cavity, and external orifaces formed between the radial slots. A spring is interposed between the spider and plug to bias the plug in a sealing matter against the bottle mouth while the inner lips of the four legs of the spider securely clamp onto a circumferential flange formed onto a neck of the bottle to maintain the device in place.

It is an advantage of the present invention that the closure acts to minimize the opportunity for particulate matter to enter the liquid within a bottle or container when removing or replacing the closure.

It is a further advantage of the present invention that toxic and corrosive materials are sealed within the container, and access to them is provided via a fluid channel.

It is yet another advantage of the present invention that the closure may be quickly and easily inserted and removed.

It is yet another advantage of the present invention that the closure device can be made to fit virtually any size container.

These and other objects and advantages of the present invention will no doubt become obvious to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
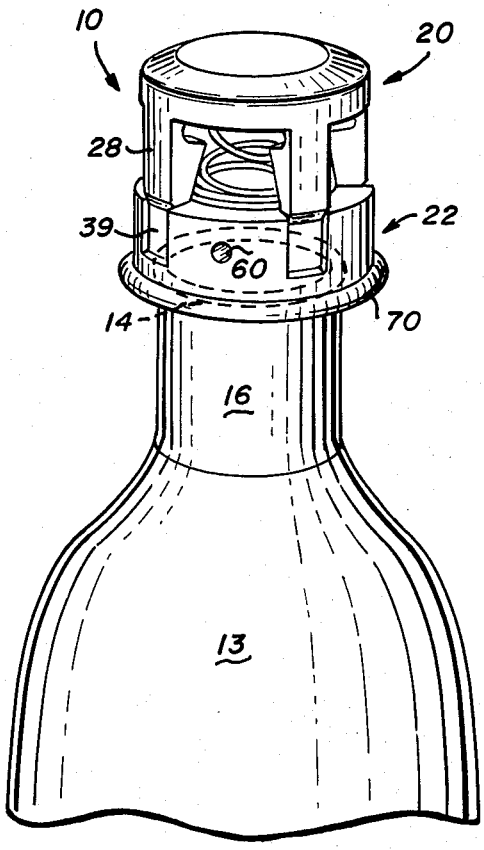
FIG. 1 is a perspective view of the closure device of the present invention.

FIG. 1 illustrates the closure of the present invention and referred to by the general reference character 10. The closure 10 is sealingly fitted to a mouth (not shown) of a container 13, having a flange 14 (illustrated in phantom) formed around a neck 16 thereof and just under the mouth.

Figure 2:
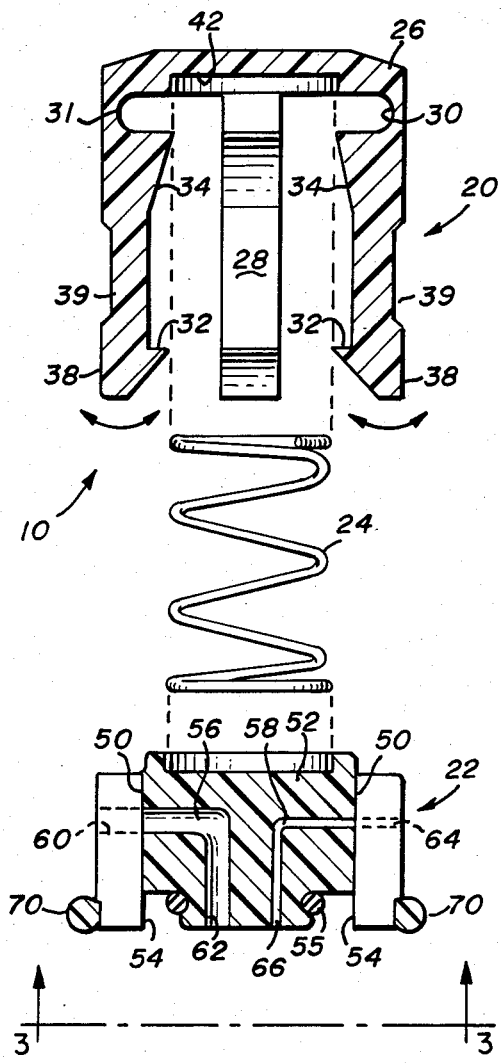
FIG. 2 is an exploded side view, partially in section, of the closure of FIG. 1.

Referring to FIG. 2, the closure device 10 includes a spider portion 20, a plug portion 22, and a spring 24, interposed therebetween to urge the portions 20 and 22 apart. The spider portion 20 comprises a generally disk-shaped upper portion 26 to which a plurality of legs 28 are attached to be perpendicular to the top portion 26. While the number of legs 28 may vary from two to four or more as needed to secure the device 10, four legs 28 are used in the device 10. Each leg 28 is resiliently attached to the top portion 26 to flex in an outward direction as indicated by the arrows of FIG. 2, and in the device 10 the legs 28 and the top 26 are fabricated as a unitary piece with flexibility provided by fabricating each leg to have a thin-walled section 30. A gripping surface for abutting and gripping the flange 14 of the bottle 13 is provided by an inward facing lip 32 formed at a distal end of each leg 28. At a proximal end of each leg 28 and below the thin-walled section 30 is a wedge portion 34, also which is inward facing and is thickest near the top portion 26. The wedge 34, in conjunction with the plug 22 provides the means by which the legs 28 are urged outward to fit over the flange 14 of the bottle neck 16.

In the closure device 10, the wedge 34 is inclined relative to the leg 28 by an angle of approximately fifteen degrees. However, this angle is not critical and can vary as long as the angle is sufficient to adequately open the legs 28. Opposite to each lip 32 is an outward facing seal face 38. The seal face 38 is of a length sufficient to accommodate a wide variety of sizes of the bottle neck 16. In the device 10, the seal face 38 is approximately four-tenths of an inch long. Immediately above the seal face 38 of each leg 28 is a recess 39 which may vary in length depending on the size of the bottle 13 and in the device 10 is approximately equal to the length of the seal face 38. A downward facing cylindrical cavity 42 is formed into the top portion 26 of the spider 20, and is adapted to receive the spring 24.

The plug 22 also is generally disk-shaped, and is adapted to slidably fit within a cavity defined by the four legs 28 of the spider 20.

Figure 3:
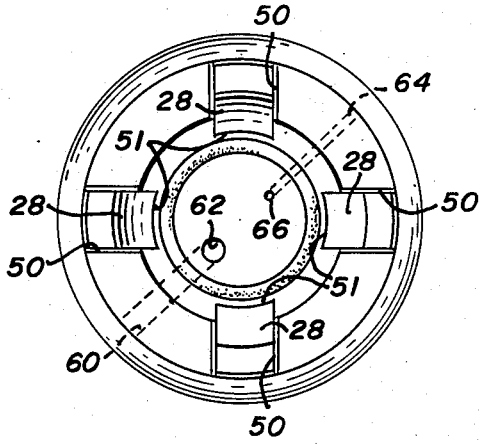
FIG. 3 is a bottom plan view, taken along line 3—3 of FIG. 2.

Referring to FIG. 3, a plurality of radial slots 50, equal in number to the plurality of legs 28, are cut into the plug 22 about the periphery thereof and are adapted to receive the legs 28 of the spider 20. In the device 10, four slots 50 are provided. It can also be seen that the lips 32 include an inner curved surface 51 for mating with the neck 16 of the bottle 13. The plug 22 includes an upper disk-shaped cavity 52 adapted to receive the spring 24, and is retained within the spider 20 by the lips 32. The plug 22 includes, about a lower surface thereof, a ring-shaped sealing cavity 54 which is adapted for receiving the mouth of the bottle 13. An O-ring 55 is seated within the cavity 54 and ensures a leak proof seal between the device 10 and the bottle 13. Also formed in the plug 22 are a first and a second fluid channel 56 and 58. The first fluid channel 56 includes an external opening 60 and an internal opening 62, and the second fluid channel 58 includes an external opening 64 and an internal opening 66. The external openings 60 and 64 are formed in a lateral surface of the plug 22 between two of the radial slots 50, and the internal openings 64 and 66 are formed within the area of the plug 22 defined by the sealing cavity 54. The fluid channels 56 and 58 may be of equal dimensions or may vary in size, and may be used to conduct liquids or gases to and from the bottle 13. Additional fluid channels may be added as needed and as space requirements dictate. Encircling the lower periphery of the plug 22 is a sealing ring 70, which abuts the seal face 38 of each leg 28. In the device 10, the sealing ring 70 is an O-ring. When the device 10 is in place about the bottle 13, the sealing ring 70 urges the legs 28 into a clamping engagement with the flange 14.

As previously described, the plug 22 is retained within the spider 20 by the lip 32, and is biased against the lip 32 by the spring 24. To insert the device 10 onto the bottle 13, the plug 22 is manually urged upward, compressing the spring 24. The slots 50 make contact with the wedges 34, and cause the legs 28 to flex outwardly. Simultaneously, such outward flexing of the legs 28 is permitted as the seal faces 38 move out of contact with the sealing ring 70 and the recesses 39 move into contact therewith. The diameter of the spider 20 at the recesses 39 is slightly less than an inside diameter of the sealing ring 70 to allow adequate spreading of the legs 28, and in the device 10, is about one-quarter inch less. The closure device 10 may then be placed onto the bottle 13, and when manual pressure on the plug 22 is released, the spring 24 urges the plug 22 downward to mate with the mouth of the bottle 13, and simultaneously the lips 32 of the legs 28 are urged into compression with the flange 14 by means of the sealing ring 70. To ensure a good grip on the flange 14, the diameter of the spider 20 at the seal faces 38 is slightly less than the inside diameter of the sealing ring 70, and in the device 10 is approximately five to ten thousandths of an inch less. The sealing cavity 54 and O-ring 55 receive the mouth of the bottle 13 which is tightly held thereagainst by the legs 28.

Access is provided to the contents within the bottle 13 via the fluid channels 56 or 58, or both. The device 10 provides a leak and spill-proof seal when in place. When the contents of the bottle 13 are used up, the device 10 can be removed and replaced on another bottle 13 simply by urging the spider 20 and plug 22 together as previously described. While the number of different materials and fabrication modes are possible to produce the device of the present invention, the closure device 10 is fabricated of teflon, and the spider portion and the plug portion are each fabricated from a unitary piece of teflon. Also while the device 10 has been described as having four legs 28, spaced ninety degrees about the circumferences of the device 10, a lesser or a greater number of legs 28 may be equally or more suitable, depending on the application.

Although the present invention has been described in terms of the presently preferred embodiment, it is to be understood that such disclosure is not to be interpreted as limiting. Various alterations and modifications will no doubt become apparent to those skilled in the art after having read the disclosure. Accordingly, it is intended that the appended claims be interpreted as covering all alterations and modifications as fall within the true spirit and scope of the invention.

I claim:

1. A quick release, sealing container closure comprising:

a generally U-shaped spider member having a plurality of flexible legs, said legs including flexing means for flexing said legs outwardly and engaging means for engaging said legs with a flange formed onto a container neck;

a disk-shaped plug member for slidably fitting within the spider member and including a plurality of slot means formed about the periphery thereof and adapted to receive said flexible legs of the spider member, the plug member further including a securing means for urging said legs into contact with said flange and fluid channel means for conducting fluids from an interior of said container to an exterior of said container, said plug member also including a sealing cavity means for receiving a mouth of said container in a sealing manner; and a biasing means to bias apart the spider and plug members, the plug member being retained within the spider by said engaging means.

2. The device of claim 1 wherein, the spider member comprises a generally disk-shaped upper portion and said plurality of legs comprises four legs extending perpendicularly downward therefrom, said legs being spaced apart about the periphery of the disk-shaped portion and constituting two opposed pairs, said engaging means comprises an inward facing lip formed to each leg, and said flexing means comprises a wedge formed to an inside surface of, and a recess formed to an outside surface of, each of said legs.

3. A device of claim 2 and further including, a thin-walled portion of each leg, formed near an upper portion thereof, whereby said leg may flex outwardly, and a seal face, formed to the outside surface of each leg whereby a sealing ring may be placed therearound in an abutting relationship to urge said legs into a clamped state.

4. The device of claim 3 wherein, the securing means comprises a sealing ring formed to the plug about a lower periphery thereof, said sealing ring being in abutting contact with said seal faces whereby said legs are urged into contact with said container flange when the plug is biased apart from the spider.

5. The device of claim 1 wherein, said biasing means is a spring.

6. A quick release, sealing container closure comprising:

a spider member having a disk-shaped upper portion and a plurality of legs extending perpendicularly therefrom, said legs being arrayed about a periphery of said disk-shaped upper portion and extending downward therefrom, each leg having a distal end terminating in an inward facing lip, said legs being flexibly attached to said disk-shaped upper portion and having a thin-walled section intermediate to the disk-shaped upper portion and to said distal end whereby expansion of the legs in a radial direction is permitted, each leg further including, on an inner proximal portion thereof a wedge, a seal face on an outside surface of said distal end, and above said seal face a recess, said legs further being radially spaced apart such that a bottle mouth may be inserted therebetween;

a disk-shaped plug member for slidably mating with the spider member about said legs, the plug including a plurality of radial channels for receiving said legs whereby said legs slidably fit within said channels, said channels having a radial spacing approximately equal to that between distal leg portions, the plug further including about a lower periphery thereof an O-ring for abutting said seal faces whereby when said O-ring abuts said distal leg portions said legs are in a contracted state, and said bottle mouth may be gripped about a circumferential flange formed therearound, and when the plug is urged towards said disk-shaped upper portion of the spider, said slots abut said wedges and said O-ring moves out of contact with said seal faces and into contact with said recesses, thereby urging said legs outward whereby said bottle may be released, said plug further including a fluid channel formed therein for transferring fluid to or from an external fluid container, said plug further including a lower ring-shaped sealing cavity for abutting said bottle mouth; and a biasing means for biasing said plug and said spider apart.

* * * * *